US012733738B2

(12) United States Patent
Yang

(10) Patent No.: US 12,733,738 B2
(45) Date of Patent: Sep. 15, 2026

(54) FOLDING CHAIR

(71) Applicant: Zhejiang Hengfeng Top Leisure Co., Ltd., Zhejiang (CN)

(72) Inventor: Baoqing Yang, HangZhou (CN)

(73) Assignee: Zhejiang Hengfeng Top Leisure Co., Ltd., Zhejiang (CN)

( * ) Notice: Subject to any disclaimer, the term of this patent is extended or adjusted under 35 U.S.C. 154(b) by 83 days.

(21) Appl. No.: 18/925,324

(22) Filed: Oct. 24, 2024

(65) Prior Publication Data

US 2025/0134259 A1 May 1, 2025

(30) Foreign Application Priority Data

Oct. 27, 2023 (CN) ..... 202322898941.9

(51) Int. Cl.
*A47C 4/44* (2006.01)
*A47C 1/14* (2006.01)

(52) U.S. Cl.
CPC . *A47C 4/44* (2013.01); *A47C 1/14* (2013.01)

(58) Field of Classification Search
CPC .... A47C 1/14; A47C 4/44; A47C 4/34; A47C 4/20
USPC ..... 297/16.1, 36, 37, 45, 44, 52, 53, 378.1
See application file for complete search history.

(56) References Cited

U.S. PATENT DOCUMENTS 1,434,777 A * 11/1922 Handler ..... B60N 2/3065 297/53
D149,161 S * 4/1948 Bond, Jr. ..... 297/16.1
4,514,009 A * 4/1985 Vanderminden ..... A47C 1/14 297/27
4,889,383 A * 12/1989 Jones ..... A47C 4/52 297/54
5,139,308 A * 8/1992 Ziman ..... A47C 4/52 224/155
5,350,215 A * 9/1994 DeMars ..... A47C 7/624 297/188.14
5,507,548 A * 4/1996 Marhefka ..... A47C 4/48 297/59
6,000,752 A * 12/1999 Shyr ..... A47C 4/38 297/188.08
6,332,646 B1 * 12/2001 Tseng ..... A47C 4/48 297/19

(Continued)

FOREIGN PATENT DOCUMENTS

CA 186421 A 9/1918
CA 201299 A 6/1920
EP 2926692 A1 10/2015

*Primary Examiner* — Maria E Graber
(74) *Attorney, Agent, or Firm* — Thompson Coburn LLP

(57) ABSTRACT

A foldable chair has a frame with a front leg frame and a rear leg frame that each comprise a U-shaped frame member with opposite legs having free ends and a transverse portion extending between the opposite legs. The transverse portions support the chair on a support surface. When the foldable chair is in an unfolded state, the front leg frame and the rear leg frame extend aslant to each other and abut against each other. A seat frame has a rear portion hinged to the rear leg frame and a front portion hinged to the front leg frame. A backrest frame has first lower portion hinged to the front leg frame, and a second lower portion hinged to the rear leg frame. The second lower portion of the backrest frame is lower than the first lower portion of the backrest frame.

10 Claims, 1 Drawing Sheet

(56) References Cited

U.S. PATENT DOCUMENTS

| | | | | |
|---|---|---|---|---|
| 6,435,607 | B1 * | 8/2002 | Liu | A61H 15/0078 297/23 |
| 6,669,280 | B1 * | 12/2003 | Wegner | A47C 4/48 297/16.2 |
| 6,764,132 | B1 * | 7/2004 | Gaertner | A47C 1/0265 297/16.2 |
| 6,899,384 | B1 * | 5/2005 | Tseng | A47C 4/24 297/53 |
| 7,011,372 | B1 * | 3/2006 | Hsieh | A47C 4/028 297/16.1 |
| 9,930,966 | B2 | 4/2018 | Yang | |
| 10,104,971 | B1 | 10/2018 | Yang | |
| 10,213,023 | B2 | 2/2019 | Yang | |
| D849,437 | S | 5/2019 | Yang | |
| 10,278,506 | B2 | 5/2019 | Yang | |
| D850,135 | S * | 6/2019 | Yang | D6/368 |
| 10,653,244 | B2 | 5/2020 | Yang | |
| 10,888,163 | B2 | 1/2021 | Cook | |
| 11,006,755 | B2 | 5/2021 | Yang | |
| 11,103,071 | B2 * | 8/2021 | Yang | A47C 3/12 |
| 11,109,682 | B2 | 9/2021 | Yang | |
| 11,284,722 | B1 * | 3/2022 | Chan | A47C 7/021 |
| 11,382,427 | B2 | 7/2022 | Yang | |
| D965,327 | S | 10/2022 | Yang | |
| 11,534,000 | B2 | 12/2022 | Cook et al. | |
| 11,751,689 | B2 * | 9/2023 | Pesek | A47C 4/04 297/16.1 |
| 11,986,100 | B2 | 5/2024 | Conn | |
| 12,096,860 | B2 | 9/2024 | Yang | |
| 2005/0088018 | A1 * | 4/2005 | Yao | A47C 4/24 297/16.1 |
| 2006/0071511 | A1 * | 4/2006 | Tseng | A47C 4/28 297/16.1 |
| 2007/0063550 | A1 * | 3/2007 | Lin | A47C 4/48 297/16.1 |
| 2008/0164727 | A1 * | 7/2008 | Zhang | A47C 4/04 297/16.1 |
| 2009/0256401 | A1 * | 10/2009 | Hensley | A47C 4/32 297/45 |
| 2011/0227373 | A1 * | 9/2011 | Cone, II | B62B 7/08 297/16.1 |
| 2012/0074737 | A1 * | 3/2012 | Huang | A47C 5/06 297/16.1 |

* cited by examiner

FOLDING CHAIR

RELATED APPLICATION DATA

This application claims priority benefit to Chinese utility model patent Ser. No. 202322898941.9 filed Oct. 27, 2023, the disclosure of which is incorporated by reference.

TECHNICAL FIELD

The present disclosure belongs to the outdoor furniture field, and specifically relates to a foldable chair frame and a foldable chair.

BACKGROUND ART

A beach chair is a type of furniture configured for relaxing and resting on beaches or outdoor leisure places, and a beach chair usually has a mechanism that is easy to fold and unfold, which allows the user to conveniently store or carry it. It usually includes a foldable frame and a soft or pliable surface. The frame of the beach chair is usually made of lightweight and durable materials such as aluminum alloy or steel. The design of the frame allows the beach chair to be folded and unfolded, making it convenient for carrying and storage. The soft or pliable surface is usually made of waterproof and durable materials, such as nylon fabric, polyester fiber, or rattan weaving. The seat can also be provided with thickened paddings to increase comfort. Beach chairs on the market are large in packaging, complex in structure, costly, and lack comfort.

SUMMARY

The present disclosure provides a foldable chair frame, wherein the foldable chair frame has an unfolded state and a folded state. The foldable chair frame includes: (i) a front leg frame and a rear leg frame, wherein the front leg frame and the rear leg frame are both U-shaped frames, and the front leg frame and the rear leg frame extend aslant and abut against each other when the foldable chair is in the unfolded or expanded state; (ii) a seat frame, wherein a rear side of the seat frame is hinged to the rear leg frame, and a front side of the seat frame is hinged to the front leg frame; and (iii) a backrest frame, wherein a lower side of the backrest frame is hinged to the front leg frame and the rear leg frame.

In some embodiments, the two free ends of the rear leg frame abut the rear side of the front leg frame when the foldable chair is in the unfolded or expanded state.

In some embodiments, the seat frame is a U-shaped frame.

In some embodiments, an opening of the seat frame faces forward.

In some embodiments, the backrest frame is a U-shaped frame.

In some embodiments, the front leg frame and the rear leg frame each comprise U-shaped frame members with two legs having ends and a transverse portion extending between the legs. The ends of the legs define an opening of the U-shaped frame. When the chair frame is unfolded, the legs of the rear leg frame extend generally vertically toward the front of the chair frame, and the legs of the front leg frame extend generally vertically toward the rear of the chair frame. The seat is hinged to the legs of the front and rear leg frame. The ends of the vertically extending legs of the rear leg frame abut an extension portion of the legs of the vertically extending legs of the front leg frame. The extension portion of the vertically extending legs of the front leg frame extend backward or rearward relative to the ends of the vertically extending legs of the rear leg frame. A first lower portion of the backrest frame is hinged to the vertically extending legs of the front leg frame, preferably at ends of the legs of the front leg frame. A second lower portion of the backrest frame, which may be the bottom or distal end of the backrest frame, is hinged to the vertically extending legs of the rear leg frame.

In some embodiments, the two free ends of the rear leg frame are provided with abutting blocks configured for abutting the front leg frame.

In some embodiments, the backrest frame is hinged to an inner side of the front leg frame and the rear leg frame.

In some embodiments, the seat frame is hinged to the inner side of the front leg frame and the rear leg frame.

When the foldable chair frame provided by the present disclosure is unfolded, the front leg frame, the rear leg frame, the seat frame, and the backrest frame form two triangular structures, and the rear leg frame abuts the front leg frame, thus forming a stable foldable chair frame structure. When folded, pressing the backrest frame will cause the front and rear leg frames to fold towards the seat frame, making folding convenient and volume smaller.

DETAILED DESCRIPTION OF EMBODIMENTS

Figure 1:
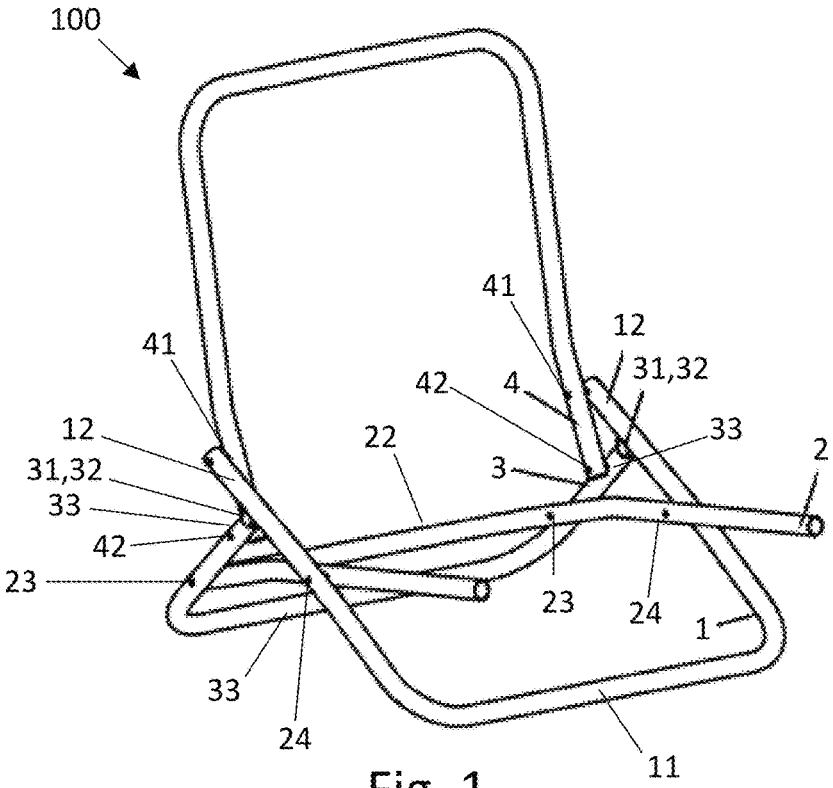
FIG. 1 to FIG. 3 are schematic structural diagrams of an exemplary foldable chair frame as the folding frame transitions from the unfolded or expanded configuration (FIG. 1) to a folded configuration (FIG. 3).

The following provides a further specific explanation of the present disclosure or the technical solution of the present disclosure through specific embodiments, in conjunction with the drawings.

In the description of the present disclosure, it should be understood that the terms "front", "rear", "left", "right", "upper", "lower", and the like, indicating orientations or positional relationships, are based on the orientations or positional relationships shown in the drawings, which is merely for the purpose of facilitating the description of the present disclosure and simplifying the description, and not to indicate or imply that the referenced device or element must have a specific orientation or be constructed and operated in a specific orientation. Therefore, such spatial orientation terms should not be understood as a limitation to the present disclosure. The term "multiple" refers to two or more.

In the description of the present disclosure, it should be noted that unless otherwise specified and defined, the terms "mount" and "connect" should be understood in a broad sense. For example, it can be mechanical connection or electrical connection, or communication between the internal elements of two components; it can be directly connected, or indirectly connected through an intermediate medium. Those skilled in the art can understand the specific meaning of the above terms based on specific situations.

Figure 2:
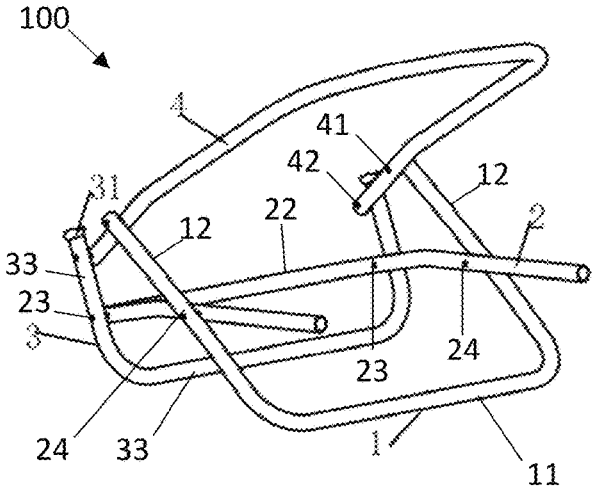
Figure 3:
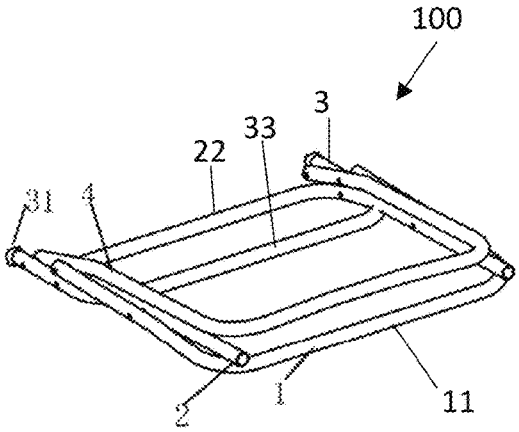

Referring to FIG. 1 to FIG. 3, the foldable chair frame 100 has an unfolded state (FIG. 1) and a folded state (FIG. 3). The foldable chair frame includes a front leg frame 1, a rear leg frame 3, a seat frame 2, and a backrest frame 4. The front leg frame 1 and the rear leg frame 3 are both U-shaped frames. When the foldable chair is in the unfolded state as shown in FIG. 1, the front leg frame 1 and the rear leg frame 3 extend aslant to each, and abut against each other. Specifically, the front leg frame 1 inclines from front to back with the opening of the U-shaped front leg frame facing rearward and the opening of the U-shaped front leg frame extending generally vertically upward. The rear leg frame 3 inclines from back to front with the opening of the U-shaped rear leg frame facing frontward and the opening of the U-shaped rear leg frame extending generally vertically upward. The transverse section 11 of the U-shaped front leg frame 1, and the transverse section 33 of the U-shaped rear leg frame are configured to be supported on the ground. The seat frame 2 may be a U-shape with the opening of the U-shaped seat frame facing forward and the transverse section 22 of the U-shaped frame being at the rear of the chair frame. A rear portion of the seat frame 2 adjacent to the transverse section 22 of the U-shaped seat frame may have a hinged connection 23 to the rear leg frame 1. A portion of the seat frame 2 intermediate of an end of the U-shaped seat frame and the transverse section of the U-shaped seat frame 2 may have a hinge connection 24 to the front leg frame 1. A lower portion of the backrest frame 4 is hinged to both the front leg frame 1 and the rear leg frame 3. In this way, when the chair frame 100 is unfolded and expanded, the rear leg frame 3 abuts the front leg frame 1, thus forming one triangular structure by the front leg frame 1, the rear leg frame 3, and the backrest frame 4, and forming another triangular structure by the front leg frame 1, the rear leg frame 3, and the seat frame 2. The two triangular structures form a stable foldable chair structure. The U-shaped design of the front leg frame 1 and the rear leg frame 3 provides stability and support, with the front leg frame 1 and the rear leg frame 3 supporting the mounting of the seat frame and the backrest frame, which provides a comfortable seat and backrest support. During folding, it only requires pressing the backrest frame in the direction toward the seat frame, and the front and rear leg frames will fold towards the seat frame, thus quickly achieving the folding function. The overall structure is simple, and folding is convenient.

In some embodiments, the U-shape of the rear leg frame 3 opens upward when the foldable chair is in the unfolded state, and the two free ends 31 of the rear leg frame (i.e., the two open ends of the U-shaped frame) abut a rear portion 12 of the front leg frame. In this way, the problem of the prior art frames is eliminated, that is, where the ends of the rear leg frame extend past the front leg frame into the seat frame region, causing the ends of the rear leg frame to abut the user's waist. In one embodiment of the present disclosure, the free ends 31 of the rear leg frame 3 are provided with abutting blocks configured for abutting the front leg frame. The abutting blocks 32 in the free ends 31 of rear leg frame 3 can limit the position of the front leg frame 1, and lock the chair frame 100 in the unfolded state. Optionally, since foldable chair frame 100 may be constructed from a metallic material, to avoid friction and fretting wear of the chair frame, the abutting blocks 32 can be made of anti-friction materials.

Additionally, relying on the abutment fit between the front leg frame 1 and the rear leg frame 3, the backrest frame 4 may be hinged to the inner side of the front leg frame 1 and the rear leg frame 3. Compared to the prior art where the front leg frame, the rear leg frame, and the backrest frame are hinged side by side, the backrest frame 4 as disclosed herein is further away from the front end of the seat frame 2, thus leaving more seating and reclining space for the seat frame 2.

The seat frame 2 is a U-shaped frame. The opening of the seat frame 2 faces forward, with the transverse portion of the seat frame at the rear of the chair frame. No transverse section is provided at the front part of the seat frame 2. The design allows the user to comfortably place their legs inside the seat frame while sitting on the beach chair, thus providing sufficient space and support.

As shown in the drawings, each of the frames (the front leg frame 1, the rear leg frame 3, the seat frame 2, and the backrest frame 4) is a U-shaped frame comprising a transverse section and two legs extending from the transverse section.

The ends 31 of the legs of the rear leg frame 3 abut the rearwardly extending portions 12 of the front leg frame 1, thereby providing a stable support for the foldable chair. The legs of the front leg frame 1 have the rearwardly extending portion 12 extending backward relative to the ends 31 of the legs of the rear leg frame 3. A lower portion of each of the legs of the backrest frame 4 has a hinge connection 41 to the ends of the legs of the front leg frame 1. A bottom end of each of the legs of the backrest frame 4 has a hinge connection 42 to the legs of rear leg frame 3. Each of the legs of the rear leg frame 3 has an extension portion 33 between the hinge connection 42 of the backrest frame and the legend 31. The extension portion 12 of the front leg frame 1 has a longer length compared to the extension portion 33 of the rear leg frame 3. In this way, when the foldable chair frame 100 is unfolded, the front leg frame, the rear leg frame, the seat frame, and the backrest frame form two triangular structures, and the rear leg frame abuts the front leg frame, thus forming a stable foldable chair frame structure. When folded, pressing the backrest frame 4 will cause the front and rear leg frames 1,3 to fold towards the seat frame 2, making folding convenient and the volume of the chair frame 100 smaller.

In particular, to facilitate folding, the backrest frame 4 is hinged to the inner sides of the front leg frame 1 and the rear leg frame 2, and the seat frame 2 is hinged to the inner side of the front leg frame 1 and the rear leg frame 2, thereby significantly reducing the volume of folding.

The foldable chair provided by the present disclosure has a simple and reliable structure, relatively low realization cost, small volume of folding, and good market prospects.

In the description of this specification, references to terms such as "one embodiment", "some embodiments", "specific examples", or "some examples" mean that the specific features, structures, materials, or characteristics described in connection with that embodiment or example are included in at least one embodiment or example of the present disclosure. In the summary, the illustrative expressions for the terms above do not necessarily refer to the same embodiment or example. Moreover, specific features, structures, materials, or characteristics described can be appropriately combined in any one or more embodiments or examples.

Although the embodiments of the present disclosure have been shown and described, those skilled in the art can understand that various changes, modifications, substitutions, and alterations can be made to these embodiments without departing from the principles and spirit of the present disclosure, and the scope of the present disclosure is defined by the claims and their equivalents.

What is claimed is:

1. A folding chair being configurable in an unfolded state and a folded state, the foldable chair having a chair frame, the chair frame comprising:

a front leg frame and a rear leg frame, the front leg frame and the rear leg frame each comprising a U-shaped frame member having opposite legs with free ends and a transverse portion extending between the opposite legs, the transverse portion of each of the front leg frame and the rear leg frame supporting the chair frame on a support surface, wherein when the foldable chair is in the unfolded state, the front leg frame and the rear leg frame extend aslant to each other and abut against each other;

a seat frame, a rear portion of the seat frame being hinged to the rear leg frame, a portion of the seat frame forward of the rear portion being hinged to the front leg frame; and a backrest frame, a first lower portion of the backrest frame being directly hinged to the front leg frame, a second lower portion of the backrest frame being directly hinged to the rear leg frame, the second lower portion of the backrest frame being lower than the first lower portion of the backrest frame.

2. The folding chair according to claim 1, wherein the backrest frame is directly hinged to an inner side of the front leg frame and directly hinged to an inner side of the rear leg frame.

3. The folding chair according to claim 1, wherein the seat frame is hinged to an inner side of the front leg frame and an inner side of the rear leg frame.

4. The folding chair according to claim 1, wherein when the foldable chair is in the unfolded state, the free ends of the rear leg frame abut a rearwardly extending portion of the front leg frame.

5. The folding chair according to claim 4, wherein the first lower portion of the backrest frame is directly hinged to the rearwardly extending portion of the front leg frame.

6. The folding chair according to claim 4, wherein the free ends of the rear leg frame comprise abutting blocks configured for abutting the rearwardly extending portion of the front leg frame.

7. The folding chair according to claim 1, wherein the seat frame is a U-shaped frame member having opposite legs with free ends defining an opening to the U-shaped frame member and a transverse portion extending between the opposite legs.

8. The folding chair according to claim 7, wherein the opening of the U-shaped frame member of the seat frame faces forward.

9. The folding chair according to claim 1, wherein the backrest frame is a U-shaped frame having opposite legs with free ends and a transverse portion extending between the opposite legs.

10. The folding chair according to claim 5, wherein when the chair frame is in the folded state, the transverse portion of the back rest portion is positioned toward the transverse portion of the front leg frame, and the transverse portion of the rear leg frame is positioned toward the transverse portion of the front leg frame.

* * * * *